United States Patent [19]

Glenday et al.

[11] 4,109,538

[45] Aug. 29, 1978

[54] STARTER BRACKET FOR LAWN MOWERS

[76] Inventors: Martin J. Glenday, 5010 Sand Lake, Rte.1, Onsted, Mich. 49265; Cecil G. Blank, 1734 Wellesley Dr., Toledo, Ohio 43606

[21] Appl. No.: 815,725

[22] Filed: Jul. 14, 1977

[51] Int. Cl.[2] ..... F02N 3/02; F02N 3/04

[52] U.S. Cl. ..... 74/6; 74/140; 74/512; 123/179 SE; 123/185 A

[58] Field of Search ..... 74/139, 140, 141, 6, 74/512; 123/179 SE, 185 A, 185 BA, 185 BB

[56] References Cited

U.S. PATENT DOCUMENTS

| | | | |
|---|---|---|---|
| 1,021,493 | 3/1912 | Sutliff | 123/185 A |
| 1,128,911 | 2/1915 | Smith | 123/185 BA |
| 1,129,026 | 2/1915 | Stitt | 123/185 BA |
| 1,236,176 | 8/1917 | Irvine | 74/141 |
| 2,731,007 | 1/1956 | Benson | 123/185 BA |
| 2,850,003 | 9/1958 | Konle | 123/185 |
| 2,912,966 | 11/1959 | Mitchell | 123/185 BA |
| 3,212,487 | 10/1965 | Johnson | 123/185 |
| 3,626,937 | 12/1971 | Gjovik | 123/185 A |

*Primary Examiner*—Allan D. Herrmann
*Attorney, Agent, or Firm*—Henry K. Leonard

[57] ABSTRACT

A starter bracket that is mountable on a part of the handle frame of a machine such as a lawn mower which has a pull-cord starting device. The bracket has an extensible post carried by a clamp which can be positioned on the frame so that the post extends downwardly into contact with the surface on which the mower stands. An extension cable passes over a guide in the clamp and has means on one end for coupling the cable to the handle on the pull-cord and a stirrup or foot pedal on the other end for engagement by the user's hand or foot. The post can be collapsed when not in use and swung around the clamp to a storage position. A recoil spring may be engaged with the cable or stirrup for assisting the starting device in restoring the pull-cord and cable to retracted positions. A preferred embodiment also has a motion multiplying device by which the pull cord is moved a distance greater than the distance of movement of the stirrup.

10 Claims, 14 Drawing Figures

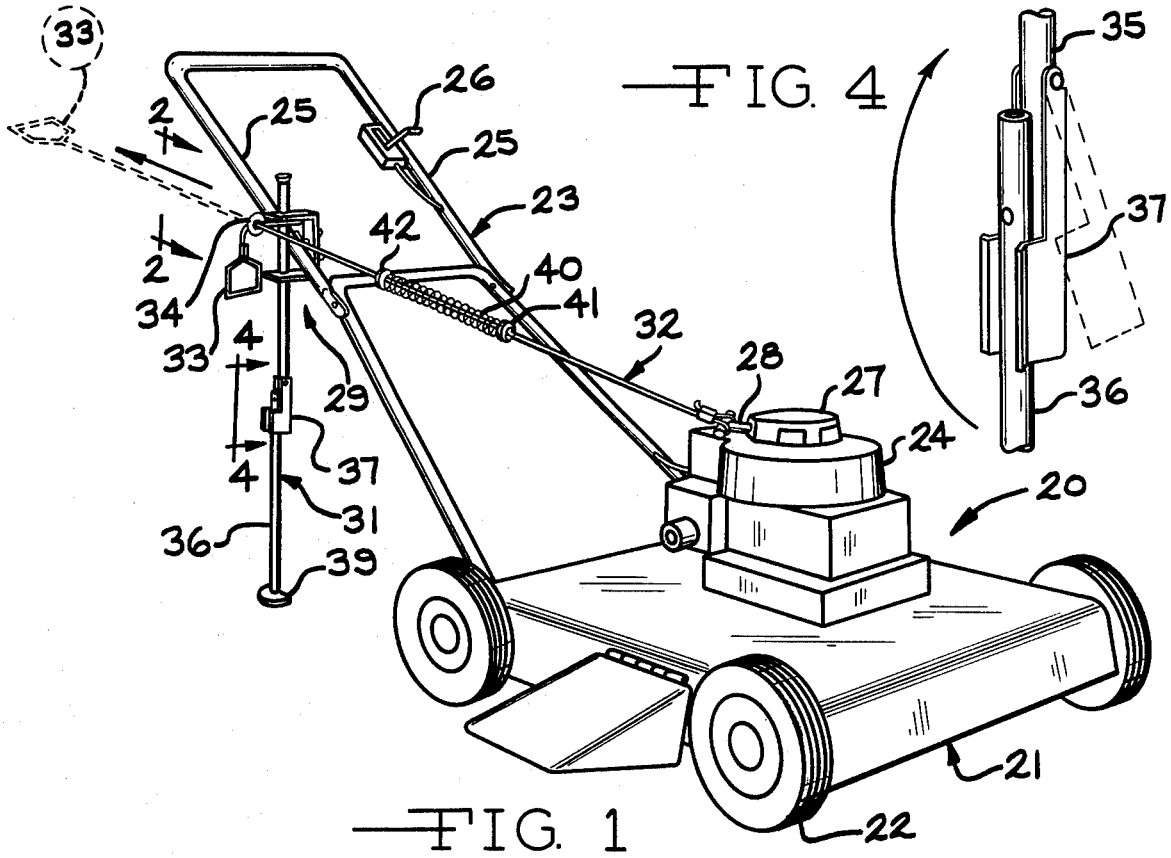
FIG. 1
FIG. 4
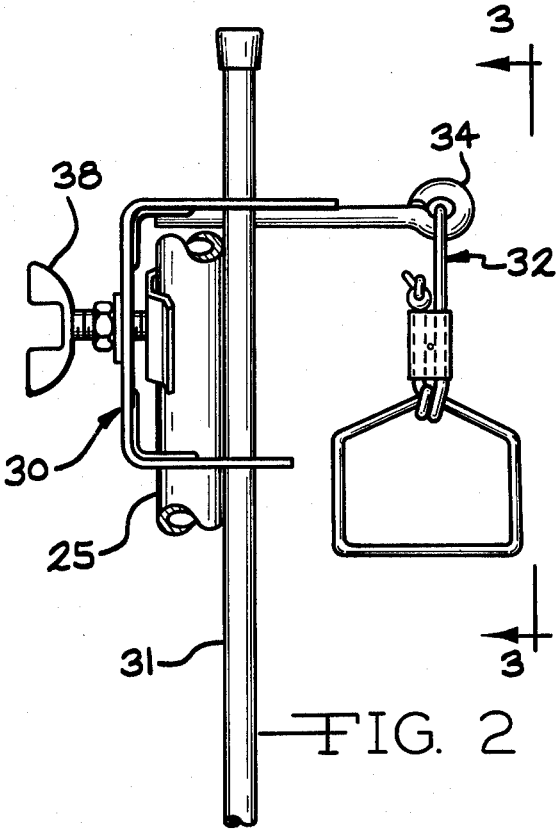
FIG. 2
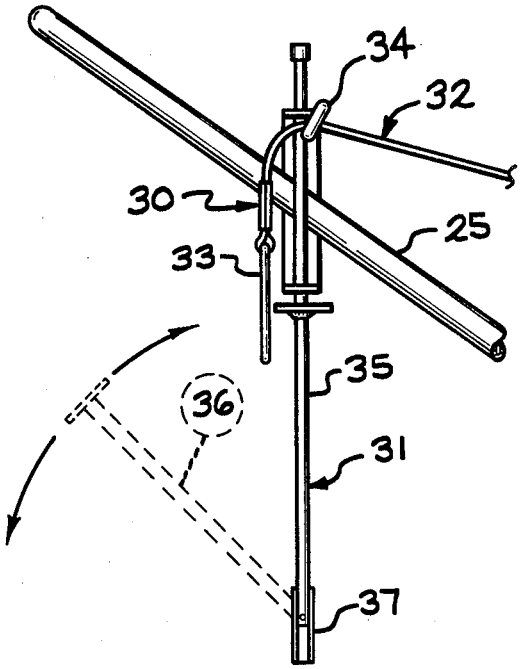
FIG. 3

STARTER BRACKET FOR LAWN MOWERS

BACKGROUND OF THE INVENTION

Most small lawn mowers, particularly of the rotary type, have single cylinder gasoline engines with pull-cord starting devices of the recoil type mounted on top of their housings and usually have handles which consist of two tubular members extending upwardly and rearwardly from the housing where the throttles are located and by which the lawnmowers are maneuvered.

The recoil starter of such a lawn mower usually has a cord which is wrapped around a drum and the cord usually has a somewhat "T"-shaped handle which the user grasps in one hand in order to pull the starting device. Sometimes the cord is pulled horizontally; sometimes vertically; sometimes at an angle upwardly from the horizontal. In any case, it is difficult for the user both to hold the mower in place, as by putting his foot on the housing or trying to hold the mower handle and simultaneously bending over and pulling the starting cord. This is particularly hard for either women or older men. In addition, when the cord is pulled one or the other corner of the mower often is lifted off the ground exposing the dangerous rotating blades.

It is, therefore, the principal object of the instant invention to provide a starter bracket which readily can be mounted on one of the handle members of such a lawn mower and will not only facilitate actuation of the pull-cord of the recoil starter but also will steady the entire machine when the starter is being pulled.

It is yet another object of the instant invention to provide a starter bracket for a lawn mower, or similar device such as a rotary tiller or gasoline powered edger, or the like, wherein the device can be removably mounted upon one of the standard handle elements so that it can be positioned either in a rest position out of the way and not interfering with the operation of the device or in a position wherein it steadies the lawn mower itself and provides an accessory which can readily be grasped at a more reasonable level or even actuated by foot power rather than by pulling by hand.

Other and more specific objects and advantages of a starter bracket embodying the invention will be better understood from the specification which follows and from the appended drawings.

BRIEF DESCRIPTION OF DRAWINGS

FIG. 1 is a view in perspective of a standard type lawn mower equipped with a starter bracket embodying the invention;

FIG. 2 is a fragmentary view in elevation with parts broken away taken generally from the position indicated by the line 2—2 of FIG. 1;

FIG. 3 is a fragmentary side view taken from the position indicated by the line 3—3 of FIG. 2 and shown on a slightly reduced scale;

FIG. 4 is a fragmentary view in perspective illustrating a locking hinge and taken approximately from the position indicated by the line 4—4 of FIG. 1, being shown on an enlarged scale;

DESCRIPTION OF PREFERRED EMBDOIMENT

Figure 5:
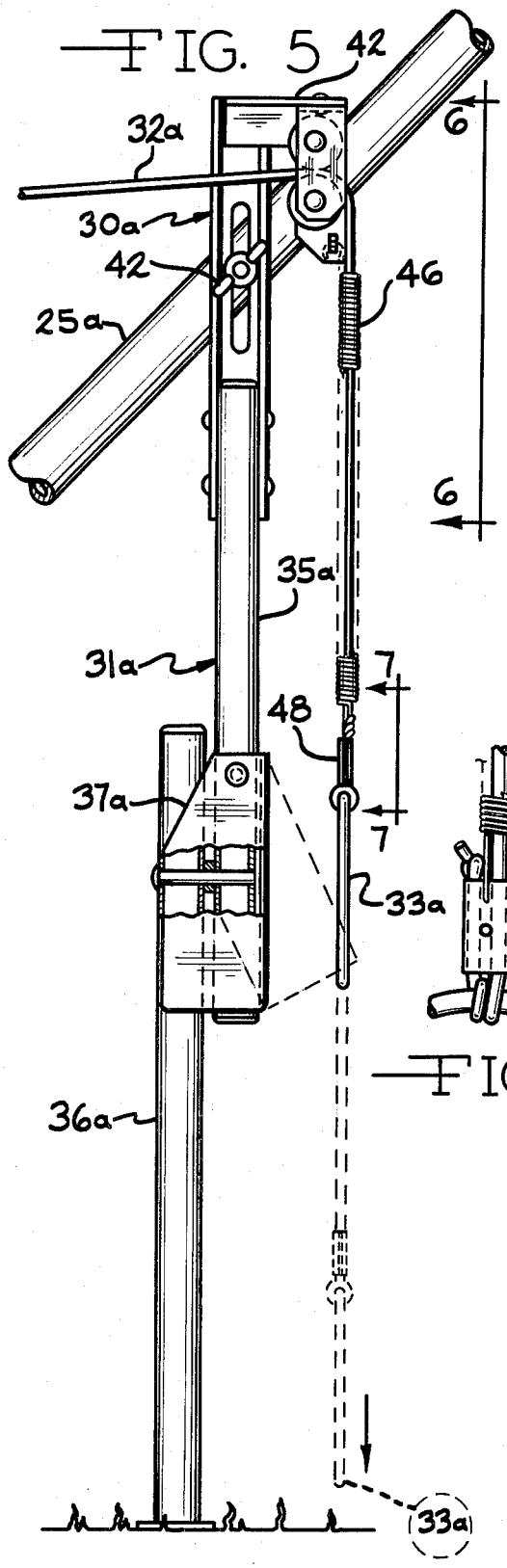
FIG. 5 is a fragmentary view in side elevation, with parts borken away, of another embodiment of a starter bracket embodying the invention particularly providing for actuation by either hand or foot.

A lawn mower of the general type with which a starter bracket embodying the invention is adapted to be employed is generally indicated by the reference number 20 and, commonly, comprises a main housing 21 mounted on wheels 22 which is pushed and/or guided by the operator by means of a handle 23 and has a top mounted gasoline engine generally indicated by the reference number 24. Typically, a handle 23 for a mower of this general type comprises two tubular members 25 which extend upwardly and rearwardly from the housing 21, on one of which there often is mounted an engine throttle 26. The engine 24 on a mower of this general type usually is provided with a recoil starting device 27 which has a pull-cord (not shown) on the outer end of which there is connected a generally "T"-shaped handle 28.

In order to start such a mower, the user advances the throttle to the "start" position and then pulls on the handle 28 which rotates the starting device 27 thus rotating the crank shaft of the engine 24 until it starts. However, in many cases, it is extremely difficult to pull the starting cord by means of the handle 28 while still preventing the mower 20, as a whole, from moving or being at least partially lifted off of one or more of its wheels as the starting cord is violently pulled. It frequently also is difficult, if not impossible, to both hold the mower handle 23 to prevent the mower from moving while the engine is being started or to control the throttle 26 during that time.

A starter bracket embodying the invention in this modification is generally indicated by the reference number 29 and comprises, among other detailed parts, a clamp 30, a post 31, an extension cable 32, a stirrup or handle 33 connected to the end of the cable 32 and a guide 34 for the cable 32.

In the embodiment of the invention illustrated in FIGS. 1-3, inclusive, the post 31 comprises two parts, an upper section 35 and a lower section 36. The two post sections 35 and 36 are pivotally connected to each other as is best illustrated in FIG. 4 and can be locked either in extended position as shown in solid lines in FIG. 1 or in folded position as illustrated in broken lines in FIG. 3 by the use of a pivoted latch 37.

The clamp 30 of this embodiment comprises a wing nut 38 which can be tightened to secure the clamp 30 in place on the handle member 25 and an overhead arm on the end of which is located an eye which functions as the guide 34 for the extension cable 32. In FIGS. 1–4, inclusive, the stirrup 33 is illustrated as it might be connected to the extension cable 32 for manual operation, i.e., so that it can be pulled in the direction indicated in broken lines in FIG. 1 to pull the recoil starter handle 28. The post 31 is shown in its operative position in FIG. 1 so that a pad 39 on the lower end of the lower section 36 bears against the ground or other surface upon which the mower 20 is positioned when starting thus to steady the entire mower 20 when the starting device is being actuated.

A coil spring 40 is positioned circumjacent the extension cable 32 between a washer 41 fixed in position on the cable 32 and a sliding washer 42. When the stirrup 33 is pulled, in the direction indicated in broken lines and by the arrow in FIG. 1, the washer 42 is brought up against the guide eye 34 and as the pull stroke continues, the spring 40 is compressed between the washers 42 and 41. Thus, when the stirrup 33 is released, the spring 40 extends to return the auxiliary extension cable 32 along with the handle 28 of the recoil starter 27.

FIGS. 5–8

The embodiment of the invention illustrated in FIGS. 5—8 differs from that illustrated in FIGS. 1–4 in details of its elements. A clamp 30*a* is mountable on a tubular handle member 25*a* of a mover (not shown) by means of a bolt and wing nut 42 and supports a post 31*a* which has an upper section 35*a* and a lower section 36*a*. The two sections 35*a* and 36*a* are hinged to each other and retained either in extended position (FIG. 5) or in collapsed position by a latch 37*a*.

Figure 8:
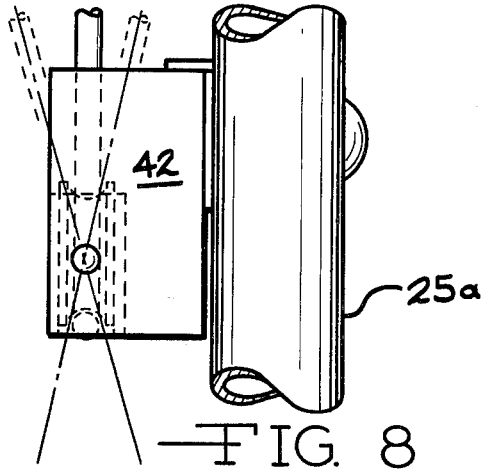
FIG. 8 is a fragmentary horizontal view, partly in the section, taken from the position indicated by the line 8—8 of FIG. 6.
Figure 7:
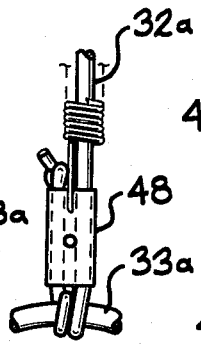
FIG. 7 is a fragmentary view in elevation taken from the position indicated by the line 7—7 of FIG. 5.
Figure 6:
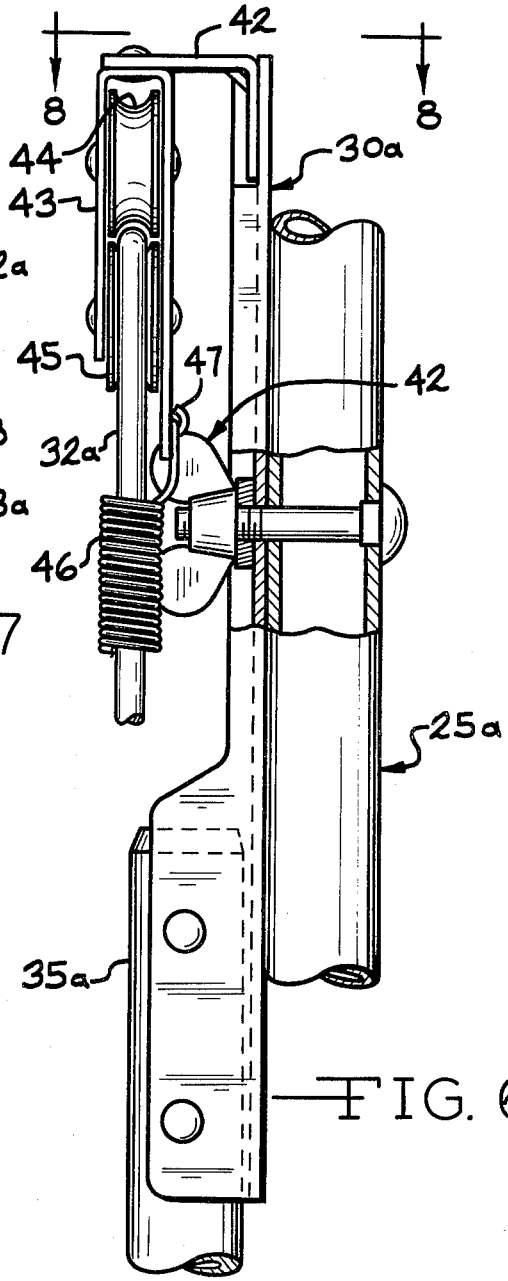
FIG. 6 is a fragmentary view in front elevation taken from the position indicated by the line 6—6 of FIG. 5 and being shown on an enlarged scale.
Figure 9:
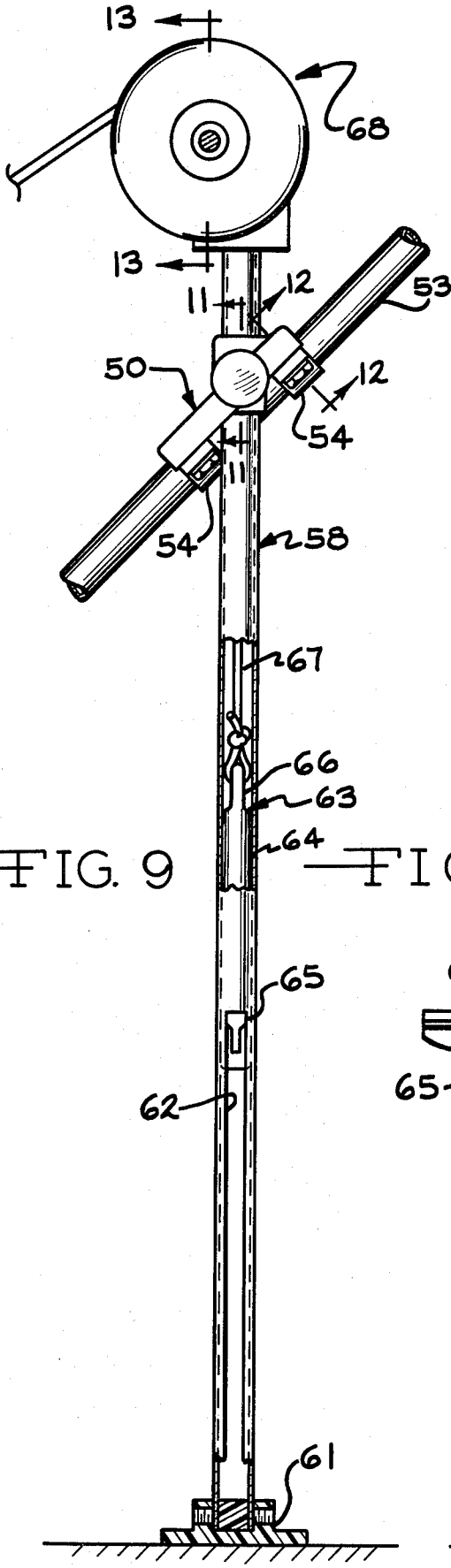
FIG. 9 is a view somewhat similar to FIG. 5 but showing a modification of the invention as particularly designed for foot operation.
Figure 10:
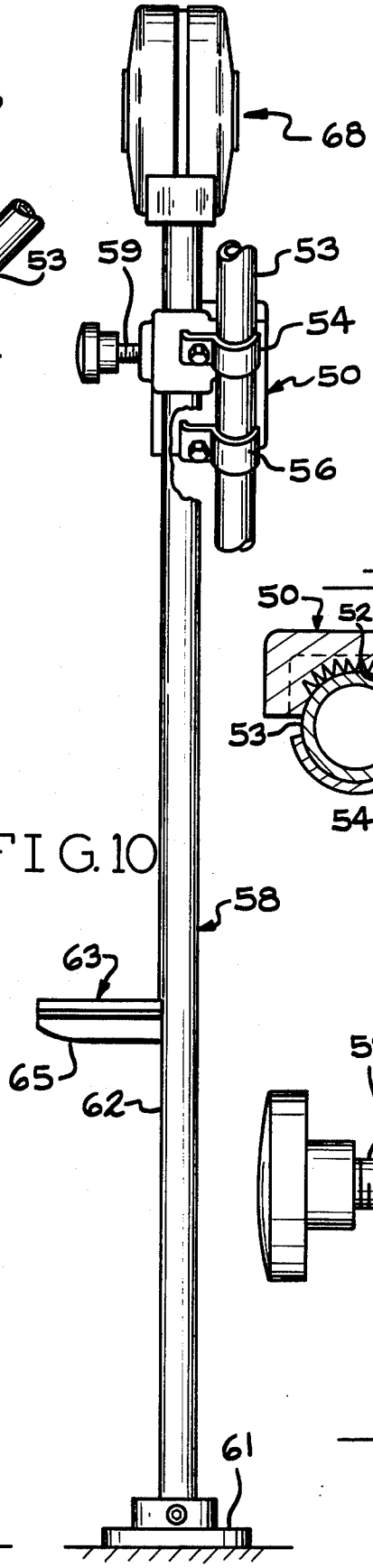
FIG. 10 is a fragmentary view in elevation taken from the right side of FIG. 9.
Figure 12:
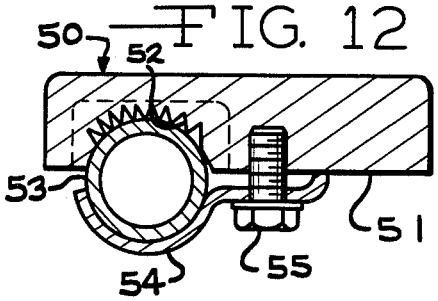
FIG. 12 is a fragmentary sectional view taken along the line 12—12 of FIG. 9 and also illustrated on a greatly enlarged scale.
Figure 11:
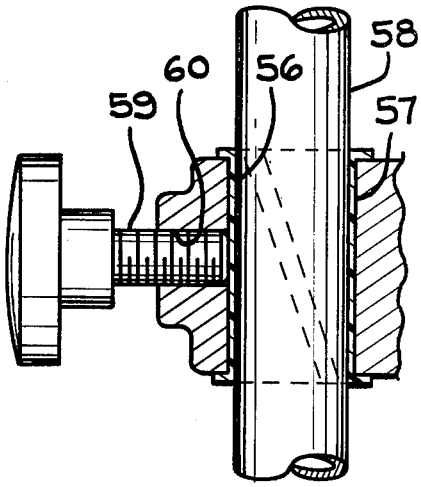
FIG. 11 is a fragmentary vertical sectional view taken along the line 11—11 of FIG. 9 and illustrated on a greatly enlarged scale.

In this embodiment the clamp 30*a* comprises an overhanging bracket arm 42 which supports a depending yoke 43 in which a pair of grooved pulleys 44 and 45 are rotably journalled. The yoke 43 is swivelable on a vertical axis, as illustrated in FIG. 8, in order that the extension cable 32*a* may lead directly to the handle of a recoil starter so that the clamp 30*a* could be mounted upon either side of the handle of a mower such as the mower 20 of FIG. 1, being clamped to either of the two tubular handle members 25, whichever the user prefers.

In this embodiment of the invention a coil spring 46 has its upper end caught by an eye 47 on the yoke 43 and its lower end is hooked to a retainer 48 (see FIG. 7) by which the cable 32*a* is held in tight connection with the stirrup 33*a*.

FIGS. 9–14

The embodiment of the invention illustrated in FIGS. 9–14, inclusive, is a somewhat more sophisticated structure including not only those features previously described with respect to the embodiments of FIGS. 1–4 and 5–8, respectively, but also including a motion multiplying means by which the stroke of the stirrup or handle actuated by the user is multiplied into a longer distance of movement of the extension cable and thus the pull cord of a recoil starter.

In this embodiment of the invention, a clamp 50 comprises a base plate 51 in which there is milled or otherwise formed a semi-cylindrical groove at 52 (FIG. 12) having a toothed surface for engagement with a tubular mower handle member fragmentarily indicated by the reference number 53. A pair of retainers 54 are tightly squeezed against the handle member 53 by machine screws 55 which pass through the arms of the retainers 54 and are threaded into tapped holes in the plate 51.

The clamp 50 also has a bore 56 (FIG. 11) through which extends a split sleeve 57 that is positioned circumjacent a tubular post 58. A knurled thumbscrew 59 is threaded through a tapped hole 60 intersecting the bore 56 with its end bearing against the sleeve 57 in order to securely hold the clamp 50 in the selected position on the post 58.

By loosening the thumbscrew 59, the post 58 can slide through the clamp 50. When a ground pad 61 mounted on the lower end of the post 58 contacts the same surface as that upon which the mower rests the thumbscrew is tightened. Through extensive discovery it has been learned that, surprisingly enough, almost all mowers of the type herein involved are provided with handle elements 53 which extend upwardly from the ground at an angle of 45° plus or minus 2° or 3°. Therefore, angular adjustment of the post relative to the mower handle member 53 is not necessary in almost all instances.

In this embodiment of the invention, the post 58 has a longitudinally extending slot 62 cut in its lower portion, the slot extending approximately ten inches upwardly from the ground pad 61. A pedal 63 has a cylindrical body 64 located interiorly of the post 58 and a foot bar 65 which extends outwardly through the slot 62 for engagement by a user's foot. The upper end of the pedal body 64 has an eye 66 to which a cable 67 is securely fastened. The cable 67 extends upwardly through the post 58 and into the interior of a drum housing generally indicated by the reference number 68.

The drum housing 68 comprises a bifurcated bracket 69 having two spaced arms 70 and 71 and a stem 72 which extends into the upper end of the post 58 and is secured therein by crimps 73 near the upper end of the post 58. A shaft 74 for a double-grooved pulley, generally indicated by the reference number 75, is mounted in and extends between the arms 70 and 71 of the bracket 69. As can best be seen by reference to FIG. 13, the shaft 74 extends through the bore 76 in the bracket arm 71 and, its opposite end 77 is threaded so that it can be tightly screwed into a tapped hole 78 in the bracket arm 70.

The double-grooved pulley 75 is mounted on the shaft 74 for rotation and has two grooves 79 and 80 formed on its periphery. The first groove 79 has a radius one-half of that of the second groove 80 thereby providing for a 2:1 ratio between the movement of the cable 67 attached to the foot pedal 63 which is engaged with the groove 79 and an extension cable 81 leading to the handle of the mower recoil starter which is engaged with the groove 80 of larger diameter. A recess 82 formed in the face of the pulley 75 is intersected by two holes 83 and 84 which lead, respectively, from the grooves 79 and 80 to the recess 82. Thus, the cable 67 can be inserted through the recess 82 and the hole 83, wrapped around the groove 79 of the pulley 75 and then led downwardly through the post 58 to the eye 66 of the pedal 63. Similarly, the extension cable 81 can be inserted through the recess 82 and the hole 84, wrapped around the larger groove 80 and led outwardly therefrom, to the handle of the recoil starting device of the mower.

A coil spring 85 is located circumjacent a portion of the hub of the pulley 75 and hooked into the pulley 75 and into the arm 70 of the bracket 69 so that when the pedal 63 is depressed and the pulley 75 is rotated (clockwise — FIG. 14), the spring 85 is twisted more tightly. Upon release of the foot pedal 63, the spring 85 returns the pulley 75 to rest position and allows the extension cable 81 to be pulled backwardly by the springs in the recoil starting device of the mower, also elevating the foot pedal 63 upwardly into the position illustrated in FIGS. 9 and 10.

Figure 14:
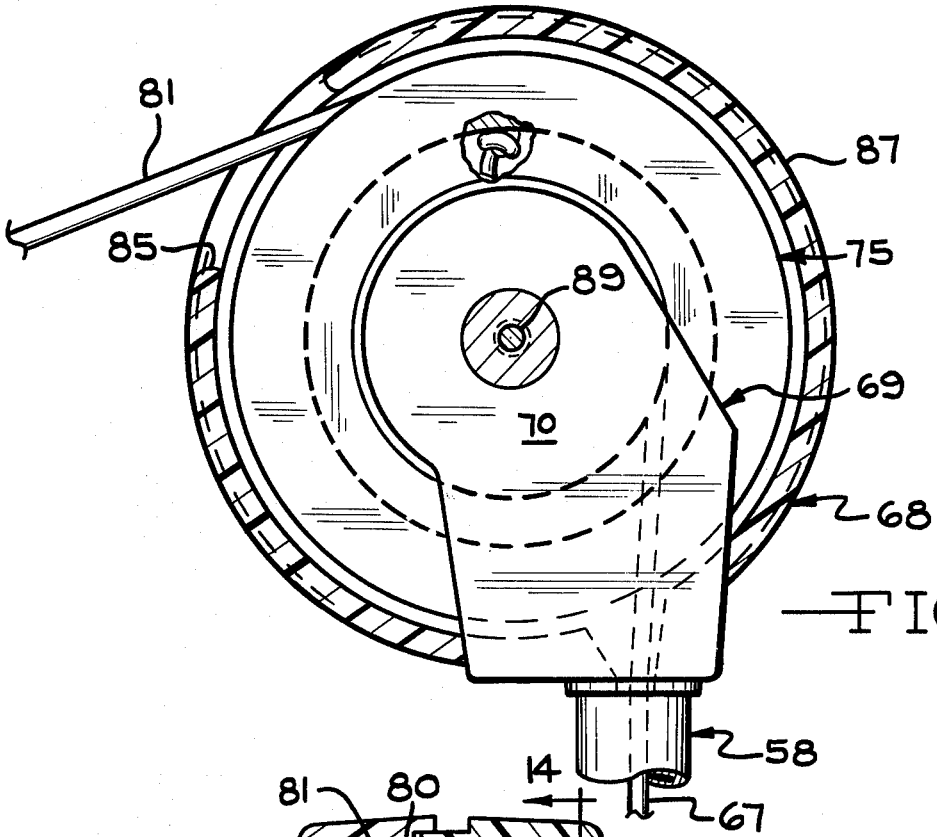
FIG. 14 is a fragmentary view in section taken along the line 14—14 of FIG. 13.
Figure 13:
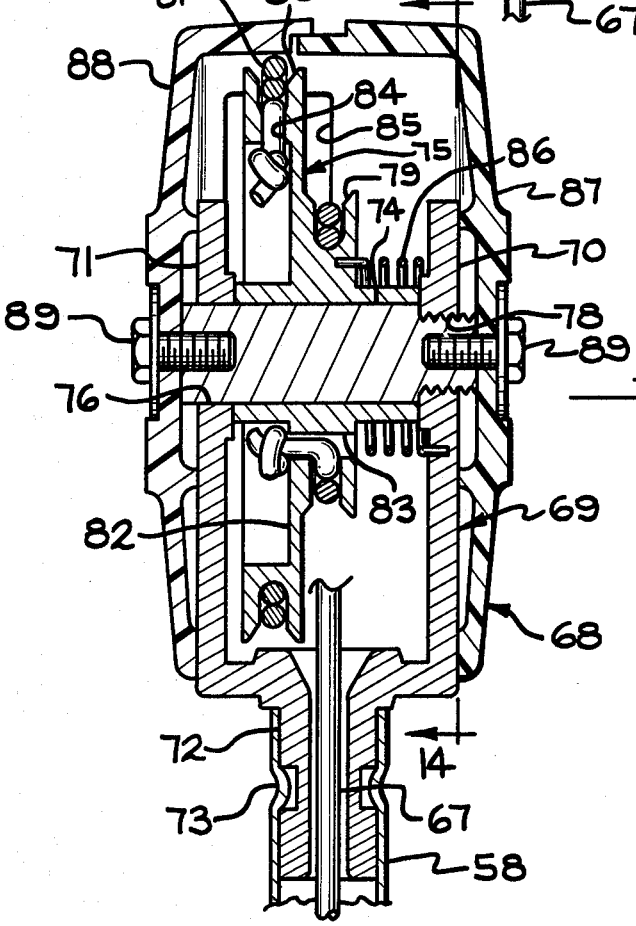
FIG. 13 is a greatly enlarged fragmentary vertical sectional view taken along the line 13—13 of FIG. 9.

As best can be seen in FIG. 14, the extension cable 81 is led from the pulley 75 forwardly to the handle of the recoil starter through an aperture 86 in the walls of a pair of dish-shaped covers 87 and 88. The covers 87 and 88 secured to the outer sides of the bracket arms 70 and 71 by machine screws 89 which are threaded into tapped holes in the respective ends of the pulley shaft 74.

Having described our invention, we claim:

1. A starter bracket for a machine having an engine and a pull-cord starting device, said bracket comprising, in combination, a. a clamp for mounting said bracket in selected position on a frame that is stationary relative to the engine, b. a post carried by said clamp that is alternatively positionable in a support position and in a storage position, c. an extension cable having on one end means for coupling said cable to the pull-cord and on the other end means engageable by a user's foot or hand, and d. a guide on said clamp for said cable.

2. A device according to claim 1 for a machine having a handle frame that extends angularly upwardly relative to the engine, said device having a clamp adapted to be mounted on said handle frame and a post which can be extended into ground-contacting support position.

3. A device according to claim 1 in which the means engageable by the user is a stirrup-like handle.

4. A device according to claim 1 in which the guide comprises a freely rotatable pulley.

5. A device according to claim 1 and a spring effective for urging the cable and pull-cord toward retracted position.

6. A device according to claim 1 in which the guide is swivelably mounted for aligning the cable with the pull-cord.

7. A starter bracket that is adapted to be mounted on a lawn mower having an engine, a pull-cord starting device and a tubular frame member that extends upwardly and rearwardly from the engine, said bracket comprising, in combination, a. a clamp for mounting said bracket on said frame member, b. a post carried by said clamp and movable longitudinally relative to said clamp, c. means for locking said post in vertical position in said clamp with the lower end of said post engaging the surface on which said mower stands, d. a foot pedal mounted by said post for vertical movement relative thereto, e. a cable having means on its end for coupling to the pull-cord, and f. means operatively connecting said pedal to said cable.

8. A starter bracket according to claim 7 in which the post is tubular and has a longitudinal slot in its wall and the foot pedal comprises a body movable interiorly of said post and a foot bar extending outwardly through the slot.

9. A starter bracket according to claim 7 in which the means operatively connecting the pedal to the cable comprises a drum having two portions of different radii mounted for rotation at the upper end of the post and in which the cable to the pull-cord is coupled to and wrapped around the portion of large radius and there is a second cable that is connected to said pedal and that is coupled to and wrapped around the portion of lesser radius, whereby vertical movement of said pedal causes movement of said pull-cord in ratio to the radii of the respective portions of said drum.

10. A starter bracket according to claim 9 and a spring for returning said drum and said pedal to rest position.

* * * * *